US010047605B2

(12) United States Patent
Zahlsen et al.

(10) Patent No.: US 10,047,605 B2
(45) Date of Patent: Aug. 14, 2018

(54) METHOD AND SYSTEM FOR WIRELESS IN-SITU SAMPLING OF A RESERVOIR FLUID

(71) Applicant: SINVENT AS, Trondheim (NO)

(72) Inventors: Kolbjorn Zahlsen, Trondheim (NO); Lars Kilaas, Trondheim (NO); Paal Skjetne, Trondheim (NO)

(73) Assignee: SINVENT AS, Trondheim (NO)

( * ) Notice: Subject to any disclaimer, the term of this patent is extended or adjusted under 35 U.S.C. 154(b) by 88 days.

(21) Appl. No.: 14/370,665

(22) PCT Filed: Jan. 9, 2013

(86) PCT No.: PCT/NO2013/050004

§ 371 (c)(1),
(2) Date: Jul. 3, 2014

(87) PCT Pub. No.: WO2013/105864

PCT Pub. Date: Jul. 18, 2013

(65) Prior Publication Data

US 2014/0377871 A1 Dec. 25, 2014

Related U.S. Application Data

(60) Provisional application No. 61/584,520, filed on Jan. 9, 2012.

(51) Int. Cl.

| | |
|---|---|
| ***E21B 49/08*** | (2006.01) |
| ***E21B 47/10*** | (2012.01) |
| *G01N 33/24* | (2006.01) |

(52) U.S. Cl.

CPC ..... *E21B 49/08* (2013.01); *E21B 47/1015* (2013.01); *E21B 49/081* (2013.01); *E21B 49/084* (2013.01)

(58) Field of Classification Search

CPC ..... E21B 47/123; E21B 47/122; E21B 47/12; E21B 47/1015; E21B 47/10; G01N 33/241; G01N 33/24

(Continued)

(56) References Cited

U.S. PATENT DOCUMENTS 6,443,228 B1 * 9/2002 Aronstam ..... E21B 47/12 166/250.11

6,655,457 B1 12/2003 Dybdahl (Continued)

FOREIGN PATENT DOCUMENTS

WO 01/04460 1/2001

OTHER PUBLICATIONS

International Search Report dated Apr. 9, 2013 in corresponding International Application No. PCT/NO2013/050004.

(Continued)

*Primary Examiner* — Christine T Mui

(74) *Attorney, Agent, or Firm* — Wenderoth, Lind & Ponack, L.L.P.

(57) ABSTRACT

It is described a method and a system for wireless in-situ sampling of a reservoir fluid from a hydrocarbon reservoir comprising obtaining a number of local samples of the reservoir fluid from different zones of the reservoir at given times. Local characterization of production fluid is obtained based on identifying chemical fingerprints of each of the number of local samples. This information can be used to determine local production rates from different zones in the well or from coming led wells.

43 Claims, 5 Drawing Sheets

$\dot{m}_i$ = mass flow rate from source rock $i$ or section $i$ of the well

(58) Field of Classification Search
USPC ..... 436/27, 25; 422/82.01, 68.1, 50; 166/250.12, 250.01, 244.1, 264
See application file for complete search history.

(56) References Cited

U.S. PATENT DOCUMENTS

| | | | | |
|---|---|---|---|---|
| 2001/0036667 | A1 | 11/2001 | Tayebi et al. | |
| 2002/0020527 | A1 | 2/2002 | Kilaas et al. | |
| 2007/0205021 | A1* | 9/2007 | Pelletier | E21B 49/10 175/59 |
| 2010/0307745 | A1 | 12/2010 | Lafitte et al. | |
| 2011/0253373 | A1 | 10/2011 | Kumar et al. | |

OTHER PUBLICATIONS

International Preliminary Report on Patentability dated Apr. 4, 2014 in corresponding International Application No. PCT/NO2013/050004.
Extended European Search Report dated Dec. 2, 2015 in corresponding European Application No. 13736132.5.

* cited by examiner $\dot{m}_i =$ mass flow rate from source rock $i$ or section $i$ of the well $\dot{m}_i =$ mass flow rate from source rock $i$ or section $i$ of the well

METHOD AND SYSTEM FOR WIRELESS IN-SITU SAMPLING OF A RESERVOIR FLUID

INTRODUCTION

The present invention provides a method and a system for in-situ sampling of a reservoir fluid from a hydrocarbon reservoir, a sampling unit and uses of the invention. The present invention also provides methods and a system for local characterization of production fluids.

BACKGROUND

One of the goals of reservoir monitoring in the oil and gas industry is to distinguish what well fluids are produced where in the well, and at what rate. With this information in hand the reservoir engineer can select different strategies for managing the production from the reservoir with respect to downstream issues (e.g. separation, precipitation, blending or production allocation) and upstream management of the reservoir (e.g. deferred production, injection well strategies etc.).

At present few if any methods exist for continuous monitoring of production rates and quality from different parts of a well.

SUMMARY OF THE INVENTION

The invention is defined in the appended claims.

In an aspect the invention provides a method for wireless in-situ sampling of a reservoir fluid from a hydrocarbon reservoir comprising: obtaining a number of local samples of the reservoir fluid from different zones of the reservoir at given times, wherein each of the number of local samples is contained in a carrying agent.

In an embodiment, obtaining a local sample may comprise at least one of mixing, absorbing or encapsulating the reservoir fluid in the carrying agent before the reservoir fluid enters a well stream. Further, a number of the carrying agents may be arranged along a production well, each carrying agent transporting a local sample of the reservoir fluid. The carrying agents carry the number of local samples to a downstream position and convey information about a position where each of the local samples was obtained. A number of carrying agents may be arranged at predetermined positions along a well, enabling forming of a map of how a composition of the reservoir fluid changes along the length of the well. A number of carrying agents may also be positioned in different wells, enabling forming of a map of how a composition of the reservoir fluid changes within and/or between wells. The carrying agent may comprise a unique tracer enabling position determination of each local sample along the well. The carrying agent may also comprise a unique tracer enabling determination of well of origin of each local sample between wells.

In an embodiment, the method also comprises topside isolation of carrying agent at given times relative to downhole release. Chemical fingerprints of each of the number of local samples may be identified. The method may further comprise identifying a relative abundance of the identified chemical fingerprints. In a further embodiment, topside characterization of the reservoir fluid produced in the different sections of a hydrocarbon well is performed. Further, topside characterization of the reservoir fluid produced in different hydrocarbon wells may also be performed.

In a further aspect, the invention provides a sampling unit for sampling a local sample of a reservoir fluid and carrying the local sample to a downstream position, wherein the sampling unit is arranged in a hydrocarbon reservoir, and wherein the local sample is contained in a carrying agent.

In an embodiment, the carrying agent may be at least one of: a porous particle, a swellable particle, a foam, a stabilized emulsion droplet, a hollow shell particle, an absorbing material (selectively hydrophilic or hydrophobic), a cartridge, an ampoule, or a containment unit. In a further embodiment, the carrying agent may originate from at least one of: an in-situ polymerization process of monomers, from prepolymerized building blocks or from pre-polymerized matrixes designed and installed in the sampling unit during a completion phase. In a further embodiment, the carrying agent may provide encapsulation of the local sample in at least one of: an interior of the cartridge, the porous particle, the hollow shell particle, the foam or a particle-foam matrix.

The carrying agent may comprise at least one of: at least one elastomer, a foam, or a combination of at least one elastomer and a foam. The carrying agent may be in the form of a swellable shell particle, and swellable shell particle comprising at least one of siloxanes, butadienes, natural rubber or other different elastomers or polymeric systems. The carrying agent may comprise microfluidic channels generating a single or a double emulsion where an inner phase of said single or double emulsion comprises the local sample, whereby a continuos phase of the inner phase is subsequently fixed or polymerized to ensure encapsulation of the local sample.

The sampling unit may further comprise a tracer enabling position determination of the reservoir fluid along the well. The sampling unit may be embedded into a production pipe, e.g. in sand screens, inflow control device (ICD), sliding sleeves, pup joints (outer or inner ventilated special designed unit) or valve systems. The sampling unit may be installed as a separate pipe section in the well if production pipe is not installed. The sampling unit may be installed on a wireline tool and used to obtain local samples which are either released to a well flow or into a cargo space in the wireline tool.

In a further aspect, the invention provides a method for local characterization of production fluid from in-situ sampling of a reservoir fluid from a hydrocarbon reservoir comprising: obtaining a number of local samples of the reservoir fluid from different zones of the reservoir or different comingled wells at given times, and identifying chemical fingerprints of each of the number of local samples. The local samples may be obtained by the method for wireless in-situ sampling as described above. The method may further comprise analysing the identified chemical fingerprints of each of the number of local samples to provide chemical composition of the fluid sample. Production rates of the different zones of the reservoir may be establishing based on the chemical composition of the fluid sample and a ratio of the identified chemical fingerprints between the different zones.

In a further aspect, the invention provides a method for local characterization of production fluid from in-situ sampling of a reservoir fluid from a hydrocarbon reservoir comprising: obtaining a number of local samples of the reservoir fluid from different zones of the reservoir at given times using a post installed well tool, and identifying chemical fingerprints of each of the number of local samples. The method may further comprise analysing the identified chemical fingerprints of each of the number of local samples to provide chemical composition of the fluid sample. Production rates of the different zones of the reservoir may be establishing based on the chemical composition of the fluid sample and a ratio of the identified chemical fingerprints between the different zones.

In a further aspect, the invention provides a system for local characterization of production fluid from in-situ sampling of a reservoir fluid from a hydrocarbon reservoir comprising: a number of sampling units for sampling local reservoir fluids from different zones in the hydrocarbon reservoir and carrying the local reservoir fluid samples to a downstream position, and at least one analyzing device identifying chemical fingerprints of each of the number of local samples. The analyzing device may comprise means for analyzing based on ultra high resolution Mass Spectroscopy (MS) combined with multivariate data analysis e.g. Principal Component Analysis (PCA). The analyzing device may comprise means for analyzing based on general chemical analytical tools to provide chemical composition of the fluid sample. Each sampling unit may further comprise a tracer enabling position determination of the reservoir fluid along the well. Each sampling unit or set of sampling units may enable determination of from what wells the reservoir fluid originates. The system may further comprise a database comprising chemical fingerprints.

In a further aspect, the invention provides a method for monitoring of reservoir fluids from different zones in a hydrocarbon reservoir, the method comprising: obtaining a number of samples of a production flow from the hydrocarbon reservoir in a topside location; analyzing the number of samples identifying chemical fingerprints of each of the number of samples; and comparing the identified chemical fingerprints of each of the number of samples to a map of fingerprints of compositions of the reservoir fluid in the different zones in the hydrocarbon reservoir. The method may further comprise determining a relative prevalence of each of the identified compositions providing rate determination of a production flow from each of the different zones in the reservoir or from different comingled wells in the reservoir.

The methods, sampling unit and system described above may have a variety of uses. The methods, sampling unit and system described above may e.g. be used for production monitoring of hydrocarbon reservoir, for determining production rates of different fluid producing zones in a well, for determining flow rates from comingled wells, for reservoir management, for production optimization and process control downstream of reservoir, for production allocation, or for production metering.

The invention may provide a method for local rate determination of a reservoir fluid from a hydrocarbon reservoir comprising: obtaining a number of local samples of the reservoir fluid from different zones of the reservoir at given times (or as a function of time), identifying chemical fingerprints of each of the number of local samples; and providing the production rates of the different fluid producing zones in the reservoir. The invention may provide a system for rate determination of a reservoir fluid from a hydrocarbon reservoir comprising a number of sampling units for sampling local reservoir fluids from different zones in the hydrocarbon reservoir and carrying the sample to a downstream position, and at least one analyzing device identifying chemical fingerprints of each of the number of local samples. The invention provides in an even further aspect a sampling unit for sampling a local sample of a reservoir fluid and carrying the sample to a downstream position, the sampling unit is arranged in a hydrocarbon reservoir, wherein the sampling unit contains or can produce the self carrying unit.

BRIEF DESCRIPTION OF DRAWINGS

Example embodiments of the invention will now be described with reference to the followings drawings, where.

DETAILED DESCRIPTION

Figure 1:
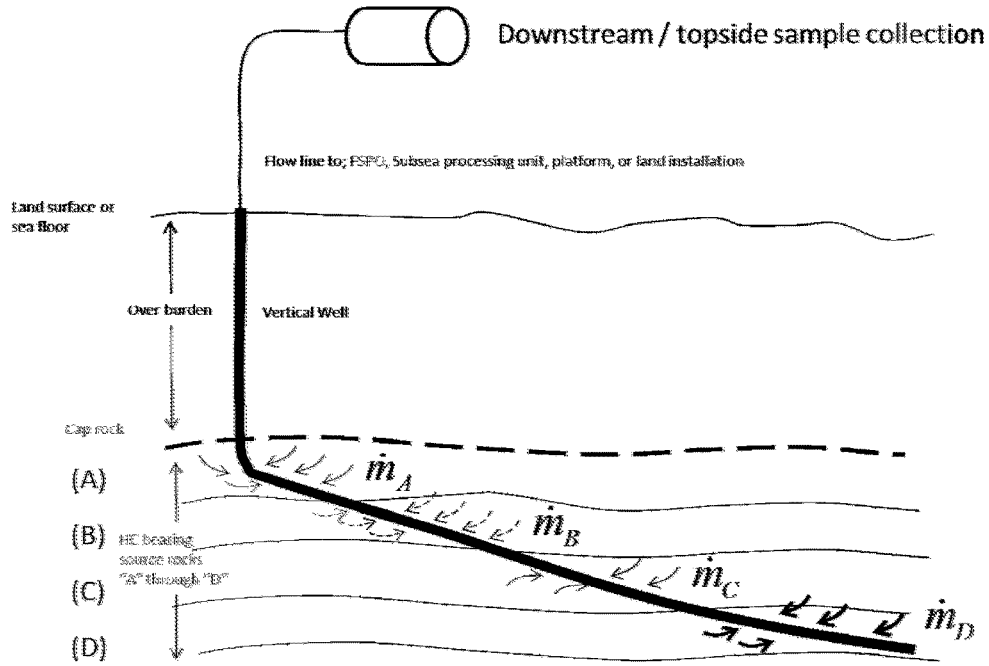
FIG. 1 illustrates a reservoir producing from four different production zones/source rocks, from each of which fluid samples may be collected according to an embodiment of the present invention.

FIG. 1 is a conceptual figure showing a reservoir producing from four different production zones/source rocks: A, B, C and D below a cap rock layer. The produced reservoir fluids $\dot{m}_A$, $\dot{m}_B$, $\dot{m}_C$, and $\dot{m}_D$ from the different production zones are transported to a downstream location, where the fluid samples are collected. The downstream location is e.g. a filter or a separator for sample collection. The produced reservoir fluids are produced from the different zones with different productions rates, A reservoir may comprise a number of different production zones, and generally $\dot{m}_i$ is the mass flow rate from source rock i or section i of the well.

A central issue in hydrocarbon production is the question of rate determination, i.e. determination of how much oil (or water) is produced from the different sections of a well or from different wells. In the present invention this may be performed based on the chemical signatures (e.g. in the form of mass spectrograms) in the produced hydrocarbon stream.

The present idea is based on a strategy for inferring local production rates based on the local composition of the reservoir fluids. The present invention comprises methods for obtaining local samples of the reservoir fluids, and then combines this information with relative prevalence of the chemical fingerprints of these local samples with those in the produced well stream. The method may be performed online.

The present invention will enable rate determination of fluids produced from the different sections, and in addition enable topside characterization of what is produced in the different sections of a well. This can be useful in the sense that if one has a method to characterize the composition of fluids as they enter the well, difficult sections may be either blocked out, treated with chemicals, or production from these sections deferred to a later time. Examples might include:

- Ionic composition of produced water from different sections of the well (e.g. important for determination of potential for corrosion or scale formation).
- Composition of hydrocarbons/fluid composition from different sections of the well (e.g. important for determination of potential problems with emulsion stability, given that the compounds responsible for emulsion stability are known).

Composition of hydrocarbons/fluid composition from different sections of the well (e.g. with respect to potential for presipitation of wax or asphalthenes or propensity for hydrate formation).

Composition of hydrocarbons/fluid composition from different wells in reservoirs to determine if they are interconnected.

Figure 2:
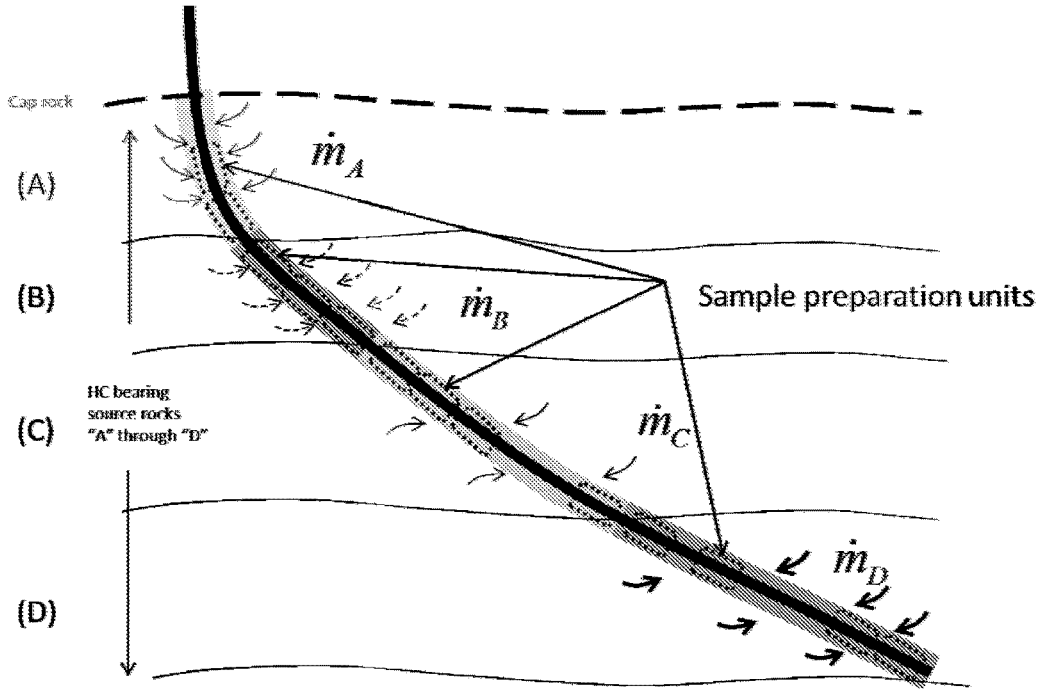
FIG. 2 schematically illustrates placement of fluid sampling units into the different production zones/source rocks of the well illustrated in FIG. 1, according to an embodiment of the present invention.

FIG. 2 schematically illustrates placement of fluid sampling units into the different production zones/source rocks of the well illustrated in FIG. 1. A number of fluid sampling units may be arranged in each production zones. In FIG. 2 two fluid sampling units are arranged in zone A, three in zone B, four in zone C and four in zone D. The number of sampling units for a production zone is determined based on knowledge or assumptions of the reservoir formation in the zone and adapted in accordance with the details needed from a zone.

Characteristics of the reservoir production fluid may be determined from each location of the fluid sampling units to provide details of the characteristics of the produced fluids from the different production zones. The characteristics include e.g. composition of the production fluids, and local rate determination of reservoir fluids.

The local fluid samples can either be obtained at given intervals (since production quality may change locally with time) using a self-moving or a wire line tool with a fluid sampling unit, or using a fluid sampling strategy embedded into the production pipe (e.g. in sand screens, inflow control device (ICD), sliding sleeves, pup joints (outer or inner ventilated special designed unit) or different kinds of designed valve systems).

Preferably the fluid samples obtained contain only fluids coming directly out of the formation before mixing with the fluid in the produced well stream.

Figure 3:
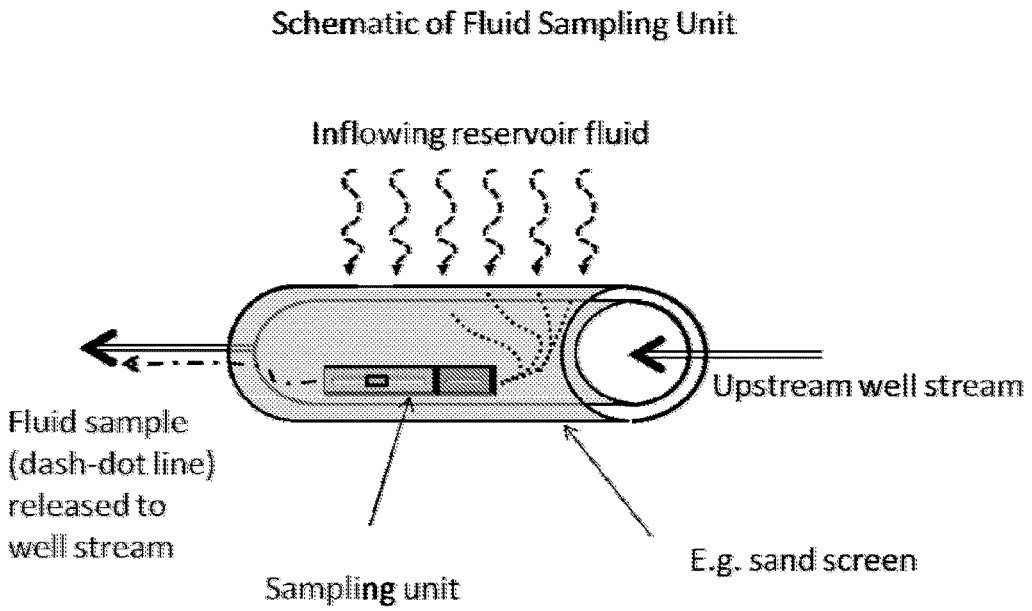
FIG. 3 is a schematic view of a fluid sampling unit according to an embodiment of the invention.

An example embodiment of a fluid sampling unit is schematically illustrated in FIG. 3. In FIG. 3 the fluid sampling unit is illustrated embedded in a predetermined position in a production pipe e.g. a sand screen. Fluid samples from inflowing reservoir fluid from the reservoir in the location of the fluid sampling unit is collected by the fluid sampling unit. The fluid sampling unit is designed to contain the local fluid sample in a carrying agent. In the illustrated embodiment in FIG. 3, the inflowing reservoir fluid is made to flow through a fluid sample preparation stage (small box in FIG. 3) where it is mixed with the carrying agent before being released into the well stream coming from the upstream location. Before release into the well stream, the reservoir fluid and carrying agent is made to flow through a flow conduit (longer box in FIG. 3) to ensure mixing and sealing of the reservoir fluid with the carrying agent.

Figure 4:
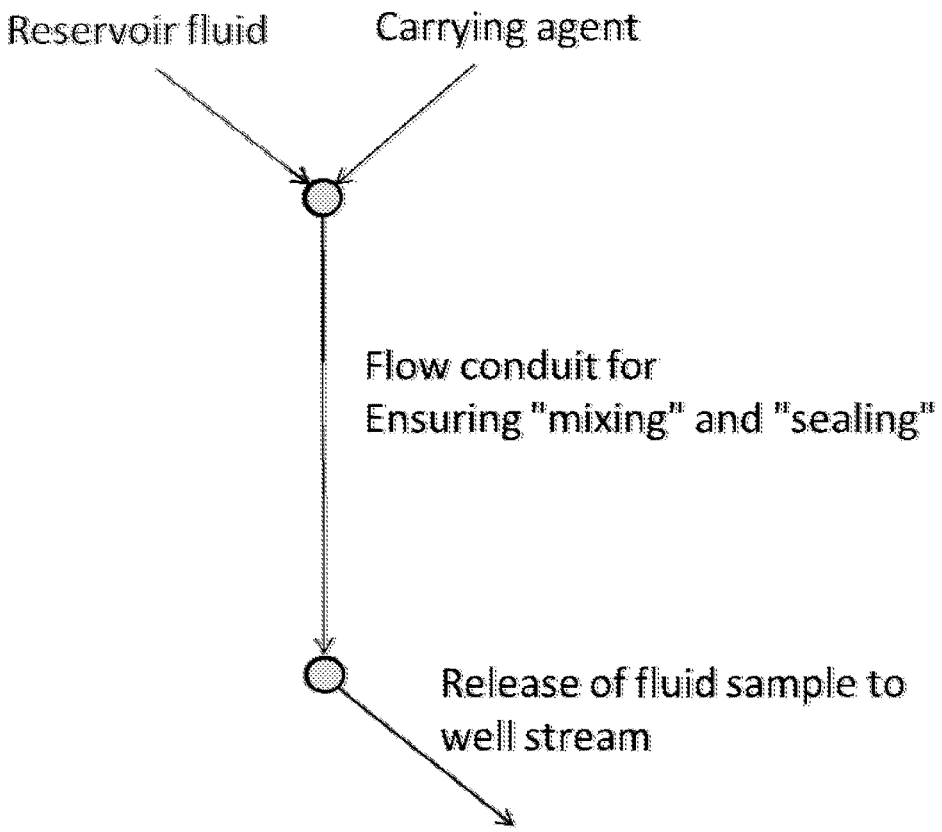
FIG. 4 illustrates a potential flow diagram showing how the reservoir fluid is brought into contact with a carrying agent according to an embodiment of the invention.

Details of the fluid sampling unit from FIG. 3 are illustrated in FIG. 4. FIG. 4 shows one potential flow diagram showing how the reservoir fluid is brought into contact with the carrying agent, and which after sufficient exposure, mixing or sealing in the flow conduit are subsequently released into the well stream.

An embodiment of an embedded fluid sampling unit may comprise different mechanical devices to assure a method for mixing the reservoir fluid with a "carrying agent". The carrying agent is generated by the sampling unit and further preserving the fluid sample in the carrying agent before the sampling unit releases the carrying agent into the well stream.

Positioning the sampling units at predetermined positions along the well or at regular intervals e.g. as illustrated in FIG. 2, one could form a map of how the composition of the reservoir fluid changes along the length of the well. Depending on the embodiment the units could either obtain a single sample or repeated samples.

The "carrying agent" can take a number of forms, e.g. porous particles, foams, stabilized emulsion droplets or ampoules/microns to millimeter sized containers. The carrying agent may also originate from an in-situ polymerization process of monomers, from prepolymerized building blocks or from pre-polymerized matrixes designed and installed in the sampling unit during the completion phase. The "carrying agent" carries the samples to a downstream position where the fluid samples can easily be separated and they convey information about the position where they were obtained. Tracers specific for each zone or location may be used for obtaining the position. The tracers may be embedded into the carrying agent. For example, different foams can produce carrying agents with high buoyancy which could enable easy sample collection in e.g. separators. Oil swellable particles comprising of e.g, siloxanes, butadienes, natural rubber or other different elastomers may be used solely or combined with foams in a way that the oil samples are encapsulated in the interior of the particle-foam matrix. Another way to encapsulate target fluids may be performed by using a unit comprising microfluidic channels (preferable lager sized channels with diameter 50-5000 μm, more preferable a diameter 500-2000 μm) to generate double emulsion where the inner phase comprises of the target fluid sample (local fluid sample) containing a unique predetermined tracer. The carrying agent with an embedded fluid sample may also be generated by controlled sectional swelling of preinstalled polymer matrixes followed by release of the swelled section (swelled with the fluid sample) into the well stream.

The system is designed in a way that the encapsulated sample is preserved downstream where samples are collected.

Figure 5:
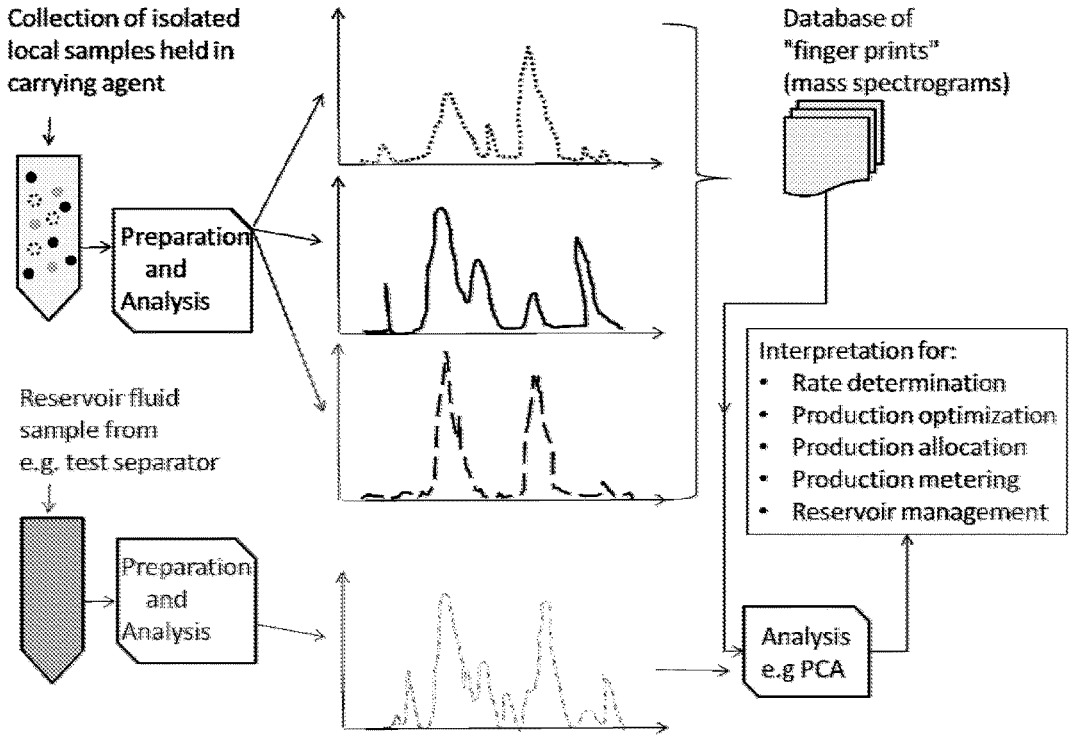
FIG. 5 is a schematic view of how a three zone analysis might be undertaken based on collected fluid samples from the three different zones, according to an embodiment of the present invention.

FIG. 5 illustrates an embodiment of how analyses might be undertaken of the local samples of the reservoir fluids coming from three zones. Three different fluid samples have been separated from the well stream; grey, black and dashed. These grey, black and dashed samples have been prepared and isolated. The analyses performed on these three samples produce in this example three distinct finger prints (grey, black and dashed graphs) which are stored in a database of fingerprints. Subsequently, after these initial analyses to obtain the fingerprints of the reservoir fluid from the different zones, further reservoir fluid is sampled either continuously or at regular intervals. Chemical analysis is used to determine the oils collective fingerprint, and PCA or another statistical method is used to determine the relative prevalence of the fingerprints found in the database. Comparison with fingerprints from zones in the reservoir stored in the fingerprint database determine ratio between zones. Production rates from the zones in the reservoir are then proportional to the ratio of the fingerprint fractions. If new fingerprint components are identified that do not match those present in the database, this is a sign that the well should be resampled in order to determine the origin of the new fingerprint components.

The concept illustrated in FIG. 5 also applies for a large number of zones and a large number of local samples. First a database of fingerprints is established based on the initial analyses of the locally isolated samples. This database of fingerprints for this reservoir thus establishes a map of how the composition of the reservoir fluid changes along the well or between wells in the reservoir. Such a map of the reservoir may be created perhaps only once a year, depending on how the reservoir changes over time. After a map of the reservoir has been created, later samples may be sampled from the reservoir fluid without use of the sampling method and sampling unit according to the invention. The later samples may be sampled by methods known in the art in order to provide samples suited for further analyses of the reservoir fluid. The later samples of the reservoir fluid from the reservoir is prepared and analysed to determine the compositions/fingerprints of the reservoir fluid in the samples. These fingerprints established from the later samples are compared with the map of fingerprints in the database. The results of this comparison may e.g. be interpreted for rate determination, production allocation, production metering or reservoir management. These interpretations are performed and related to each zone in the reservoir.

The fluid samples may be analysed using analytical chemistry. With the help of analyzing devices, e.g. ultra high resolution Mass Spectroscopy (MS) and Principal Component Analysis (PCA) for the organic phase, a map is created revealing where different qualities of hydrocarbons are produced in the well. This information can be helpful in e.g. isolating zones producing hydrocarbons containing surfactants or components that induce corrosion or separation problems downstream. Inorganic analysis could indicate where scaling potentials exist or where water is being produced. Reservoir management strategies could then use this information to e.g. defer production from that zone to a later time. However, the main use of this map will be to identify the length of zones producing similar quality hydrocarbons.

Next samples of the produced reservoir fluids are analysed using analytical chemistry, and the relative abundance of the different "fingerprints" quantified. Knowing the total production rate, the production area, and the relative abundance of the different fingerprints give a quantitative measure for the production rate from each section with distinct fingerprints of the reservoir fluid.

The present invention includes among others:

- A method to sample the reservoir fluids and to preserve the integrity of these samples until they are collected topside.
- Characterization of samples to establish their origin/position in the well using embedded tracers in the carrying agent.
- Characterization of the samples to establish their chemical fingerprint(s)
- Create a map of how the reservoir fluid changes along the well or between wells based on this information.
- Production monitoring is realized by:
  - At intervals obtain samples of the well stream topside (e.g. in the test separator, a filter unit along the pipe line or from special designed valves)
  - Analysis of relative prevalence of the different fingerprints in the produced reservoir fluids
  - Combining the above information to calculate the production rates of different fluid producing zones in the well.

The method may rely on existing methods for using analytical chemistry to characterize the composition of reservoir fluids (fingerprinting), and for incorporating tracers in the fluid sample carrying agents to aid in localization of the sample.

The invention provides a fluid sampling unit with a fluid carrying agent, that use some tracer technology for localizing the sample along the length of the well, and the use of relative ratios between fingerprints found in the produced reservoir fluids to estimate the production rates of different zones in the well. The invention can also be used in the same way to determine flow rates from comingled wells.

The method could potentially also be used to determine what zones are producing a particular quality of either hydrocarbons or formation water that cause downstream challenges.

In particular in the case of determination of hydrocarbon production rates from different zones in a well, one would prepare one or several samples in each of the sections, and then analyse the samples topside. The analysis may include mass spectrograms of the hydrocarbons produced from each section. One would then identify specific "fingerprint" patterns in these spectrograms for each section, and then by analysing the relative prevalence of each of the different "finger print" patterns determine the rate from each section. The analysis will rely on good facilities for MS and good knowledge of PCA or multivariate data analysis in general.

The present invention presents a new method for obtaining local production rates by way of localized sampling of reservoir fluids. The method may utilize already known concepts e.g. for MS/PCA analysis for "fingerprinting" or standard techniques for analytical chemistry.

A typical use of the invention for rate determination may be as follows:

- Sampling units are provided in the completion of the well, e.g. every 50 meters along a well.
- At a given time carrying agents are mixed with the reservoir fluid. The reservoir fluid is absorbed and/or is encapsulated by the carrying agents and released into the well stream.
- At a given time after the release of carrying agents into the well stream, the carrying agents are sampled topside (e.g. in filters or in test separators).
- Chemical fingerprints are determined for each sampling unit. The number of sampling units will be high, as these units are arranged every 50 meters.
- A map of fingerprints along the well is established.
- In the consecutive days/week/months samples of the fluid produced by the well are collected. The samples may be collected continuously or at regular or irregular times. The samples may e.g. be collected from the test separator. The samples are analysed with respect to fingerprints and a relative prevalence of the fingerprints are compared with the fingerprints in the map of fingerprints.
- The combination of the map established by the use of the sampling units encapsulating samples in carrying agents and the analyses of what samples occurred from which positions (where) in the well, may then be combined with e.g. daily measurements of the prevalence of produced fingerprints from the well. Based on this, it may be derived how much each section/zone produces on a daily basis without requiring new local samples.

The present invention may also be used for production metering and production allocation. The term "production allocation" is often used for situations where different production wells are co-mingled. Typically the different wells are operated by different companies or using different production optimization criteria. When pipelines and production facilities are designed, the operators allocate a given capacity according to a total predicted production volume. These allocated volumes are based on expectable production volumes from each well and hence reflects the optimum production rates to secure maximum lifetime and net operating margin of each well. The present invention makes it possible to monitor the volumes produced for each well and hence tune the production according to the predetermined allocated volumes. The term "production metering" is used for the possibility to measure the actual produced volume from each well. The operators will be paid according to their contribution of the total volume where this percentage may be calculated from fingerprints of the original fluid samples from each well and a fingerprint of a sample from the co-mingled production well stream.

Having described preferred embodiments of the invention it will be apparent to those skilled in the art that other embodiments incorporating the concepts may be used. These and other examples of the invention illustrated above are intended by way of example only and the actual scope of the invention is to be determined from the following claims.

The invention claimed is:

1. A method for wireless in-situ sampling of a reservoir fluid from a hydrocarbon reservoir, the method comprising:

obtaining a number of local samples of the reservoir fluid from different zones of the hydrocarbon reservoir at given times, wherein each of the number of local samples is contained in a carrying agent, and wherein each of the number of local samples is obtained by:

flowing the reservoir fluid through a flow conduit in a reservoir fluid sampling unit arranged in the hydrocarbon reservoir;

generating the carrying agent in-situ at the given times by the reservoir fluid sampling unit arranged in the hydrocarbon reservoir;

mixing the reservoir fluid with the carrying agent in the flow conduit while flowing the reservoir fluid through the flow conduit in the reservoir fluid sampling unit, whereby each of the number of the local samples is preserved inside the carrying agent, and whereby the carrying agent comprises a tracer unique for a zone of the hydrocarbon reservoir, the tracer identifying a zone from among the different zones where each of the number of the local samples is obtained; and releasing the carrying agent into a well stream.

2. The method according to claim 1, further comprising arranging a number of the reservoir fluid sampling units along a production well.

3. The method according to claim 1, wherein a number of the carrying agent carry the number of local samples to a downstream position and convey information about a position where each of the local samples was obtained.

4. The method according to claim 1, further comprising positioning a number of the reservoir fluid sampling units at predetermined positions along a well, enabling forming of a map of how a composition of the reservoir fluid changes along a length of the well.

5. The method according to claim 1, further comprising positioning a number of the reservoir fluid sampling units in different wells, enabling forming of a map of how a composition of the reservoir fluid changes within and/or between the different wells.

6. The method according to claim 1, wherein the carrying agent comprises a unique tracer enabling position determination of each of the number of local samples along a well.

7. The method according to claim 1, wherein the carrying agent comprises a unique tracer enabling determination of a well of origin of each of the number of local samples between wells.

8. The method according to claim 1, further comprising topside isolation of the carrying agent at given times relative to downhole release.

9. The method according to claim 1, further comprising identifying chemical fingerprints of each of the number of local samples.

10. The method according to claim 9, further comprising identifying a relative abundance of the identified chemical fingerprints.

11. The method according to claim 1, further comprising topside characterization of the reservoir fluid produced in different sections of a hydrocarbon well.

12. The method according to claim 1, further comprising topside characterization of the reservoir fluid produced in different hydrocarbon wells.

13. The method according to claim 1, further comprising production monitoring of the hydrocarbon reservoir.

14. The method according to claim 1, further comprising determining production rates of different fluid producing zones in a well.

15. The method according to claim 1, further comprising determining flow rates from comingled wells.

16. The method according to claim 1, further comprising performing reservoir management of the hydrocarbon reservoir.

17. The method according to claim 1, further comprising performing optimizing of production fluid and production fluid process control downstream of the hydrocarbon reservoir.

18. The method according to claim 1, further comprising allocating production volumes of the production flow from each production well of the hydrocarbon reservoir.

19. The method according to claim 1, further comprising metering a production volume of a production fluid from each well in the hydrocarbon reservoir.

20. The method according to claim 1, wherein the carrying agent originates from at least one of:

an in-situ polymerization process of monomers, from pre-polymerized building blocks or from pre-polymerized matrixes designed and installed in the reservoir fluid sampling unit during a completion phase.

21. The method according to claim 1, wherein the carrying agent comprises at least one of:

a foam, or a combination of at least one elastomer and a foam.

22. A sampling unit for wireless in-situ sampling of a reservoir fluid from a hydrocarbon reservoir, the sampling unit is adapted to be arranged in the hydrocarbon reservoir, the sampling unit obtaining a number of local samples of the reservoir fluid from different zones of the hydrocarbon reservoir at given times, wherein each of the number of local samples is contained in a carrying agent generated in-situ by the sampling unit, and wherein each of the number of local samples is obtained by:

flowing the reservoir fluid through a flow conduit in the sampling unit arranged in the hydrocarbon reservoir;

generating the carrying agent in-situ at the given times by the sampling unit arranged in the hydrocarbon reservoir;

mixing the reservoir fluid with the carrying agent in the flow conduit while flowing the reservoir fluid through the flow conduit in the sampling unit, whereby each of the number of the local samples is preserved inside the carrying agent, and whereby the carrying agent comprises a tracer unique for a zone of the hydrocarbon reservoir, the tracer identifying a zone from among the different zones where each of the number of the local samples is obtained; and releasing the carrying agent into a well stream.

23. The sampling unit according to claim 22, wherein the carrying agent is at least one of a foam or a stabilized emulsion droplet.

24. The sampling unit according to claim 23, wherein the carrying agent further providing encapsulation of the local sample in at least one of:

the porous particle, the hollow shell particle, the foam or a particle-foam matrix.

25. The sampling unit according to 23, wherein the carrying agent comprising at least one of:

at least one elastomer, a foam, or a combination of at least one elastomer and a foam.

26. The sampling unit according to claim 22, wherein the carrying agent is at least one of:

a porous particle, a swellable particle, a hollow shell particle, or an absorbing material.

27. The sampling unit according to claim 22, wherein the carrying agent originates from at least one of:

an in-situ polymerization process of monomers, from prepolymerized building blocks or from pre-polymerized matrixes designed and installed in the sampling unit during a completion phase.

28. The sampling unit according to claim 22, wherein the carrying agent is in the form of a swellable shell particle, and swellable shell particle comprising at least one of siloxanes, butadienes, natural rubber or other different elastomers or polymeric systems.

29. The sampling unit according to claim 22, wherein the carrying agent comprising microfluidic channels generating a single or a double emulsion where an inner phase of said single or double emulsion comprises the local sample, whereby a continuous phase of the inner phase is subsequently fixed or polymerized to ensure encapsulation of the local sample.

30. The sampling unit according to claim 22, wherein the sampling unit is embedded into a production pipe, sand screens, an inflow control device, sliding sleeves, pup joint, an outer ventilated special designed unit, an inner ventilated special designed unit, or valve systems.

31. The sampling unit according to claim 22, wherein if a production pipe is not installed, the sampling unit is installed as a separate pipe section.

32. The sampling unit according to claim 22, wherein the sampling unit is installed on a wireline tool and used to obtain local samples which are either released to a well flow or into a cargo space in the wireline tool.

33. A method for local characterization of production fluid from in-situ sampling of a reservoir fluid from a hydrocarbon reservoir, the method comprising:

obtaining a number of local samples of the reservoir fluid from different zones of the hydrocarbon reservoir or different comingled wells at given times, wherein each of the number of local samples is contained in a carrying agent, wherein each of the number of local samples is obtained by:

flowing the reservoir fluid through a flow conduit in a reservoir fluid sampling unit arranged in the hydrocarbon reservoir;

generating the carrying agent in-situ at the given times by the reservoir fluid sampling unit arranged in the hydrocarbon reservoir;

mixing the reservoir fluid with the carrying agent in the flow conduit while flowing the reservoir fluid through the flow conduit in the reservoir fluid sampling unit, whereby each of the number of the local samples is preserved inside the carrying agent, and whereby the carrying agent comprises a tracer unique for a zone of the hydrocarbon reservoir, the tracer identifying a zone from among the different zones where each of the number of the local samples is obtained; and releasing the carrying agent into a well stream, and wherein the method further comprises identifying chemical fingerprints of each of the number of local samples.

34. The method according to claim 33, wherein the number of local samples are obtained by a method for wireless in-situ sampling of a reservoir fluid from a hydrocarbon reservoir.

35. The method according to claim 33, further comprising analyzing the identified chemical fingerprints of each of the number of local samples to provide a chemical composition of a fluid sample.

36. The method according to claim 35, further comprising establishing production rates of the different zones of the hydrocarbon reservoir based on the chemical composition of the fluid sample and a ratio of the identified chemical fingerprints between the different zones.

37. A method for local characterization of production fluid from in-situ sampling of a reservoir fluid from a hydrocarbon reservoir, the method comprising:

obtaining a number of local samples of the reservoir fluid from different zones of the reservoir at given times using a post installed well tool, wherein each of the number of local samples is contained in a carrying agent, wherein each of the number of local samples is obtained by:

flowing the reservoir fluid through a flow conduit in a reservoir fluid sampling unit arranged in the hydrocarbon reservoir;

generating the carrying agent in-situ at the given times by the reservoir fluid sampling unit arranged in the hydrocarbon reservoir;

mixing the reservoir fluid with the carrying agent in the flow conduit while flowing the reservoir fluid through the flow conduit in the reservoir fluid sampling unit, whereby each of the number of the local samples is preserved inside the carrying agent, and whereby the carrying agent comprises a tracer unique for a zone of the hydrocarbon reservoir, the tracer identifying a zone from among the different zones where each of the number of the local samples is obtained; and releasing the carrying agent into a well stream, and wherein the method further comprises identifying chemical fingerprints of each of the number of local samples.

38. A system for local characterization of production fluid from in-situ sampling of a reservoir fluid from a hydrocarbon reservoir comprising:

a sampling unit for obtaining a number of local samples of the reservoir fluid from different zones of the hydrocarbon reservoir at given times; and at least one analyzing device identifying chemical fingerprints of each of the number of local samples, wherein each of the number of local samples is contained in a carrying agent generated in-situ by the sampling unit, and wherein each of the number of local samples is obtained by:

flowing the reservoir fluid through a flow conduit in the sampling unit arranged in the hydrocarbon reservoir;

generating the carrying agent in-situ at the given times by the sampling unit arranged in the hydrocarbon reservoir;

mixing the reservoir fluid with the carrying agent in the flow conduit while flowing the reservoir fluid through the flow conduit in the sampling unit, whereby each of the number of the local samples is preserved inside the carrying agent, and whereby the carrying agent comprises a tracer unique for a zone of the hydrocarbon reservoir, the tracer identifying a zone from among the different zones where each of the number of the local samples is obtained; and releasing the carrying agent into a well stream.

39. The system according to claim 38, wherein the analyzing device comprising means for analyzing based on ultra high resolution Mass Spectroscopy combined with multivariate data analysis.

40. The system according to claim 38, wherein the analyzing device comprises means for analyzing based on general chemical analytical tools to provide chemical composition of each of the number of local samples.

41. The system according to claim 38, further comprising a database for storing the chemical fingerprints.

42. A method for monitoring of reservoir fluids from different zones in a hydrocarbon reservoir, the method comprising:

obtaining a number of samples of a production flow from the hydrocarbon reservoir in a topside location, wherein each of the number of local samples is contained in a carrying agent, wherein each of the number of local samples is obtained by:

flowing the reservoir fluid through a flow conduit in a reservoir fluid sampling unit arranged in the hydrocarbon reservoir;

generating the carrying agent in-situ at the given times by the reservoir fluid sampling unit arranged in the hydrocarbon reservoir;

mixing the reservoir fluid with the carrying agent in the flow conduit while flowing the reservoir fluid through the flow conduit in the reservoir fluid sampling unit, whereby each of the number of the local samples is preserved inside the carrying agent, and whereby the carrying agent comprises a tracer unique for a zone of the hydrocarbon reservoir, the tracer identifying a zone from among the different zones where each of the number of the local samples is obtained; and releasing the carrying agent into a well stream, and wherein the method further comprises:

analyzing the number of samples identifying chemical fingerprints of each of the number of samples; and comparing the identified chemical fingerprints of each of the number of samples to a map of fingerprints of compositions of reservoir fluid in the different zones in the hydrocarbon reservoir.

43. The method according to claim 42, further comprising determining a relative prevalence of each of the identified compositions providing rate determination of a production flow from each of the different zones in the hydrocarbon reservoir or from different comingled wells in the hydrocarbon reservoir.

* * * * *